US005511407A

United States Patent [19]

Kawano

[11] Patent Number: 5,511,407

[45] Date of Patent: Apr. 30, 1996

[54] UPPER TOOL FOR PRESS BRAKE

[75] Inventor: Susumu Kawano, Kanagawa, Japan

[73] Assignee: Amada Metrecs Company, Limited, Kawagawa, Japan

[21] Appl. No.: 259,981

[22] Filed: Jun. 17, 1994

Related U.S. Application Data

[63] Continuation-in-part of Ser. No. 239,323, May 6, 1994.

[51] Int. Cl.[6] ..... B21D 37/04

[52] U.S. Cl. ..... 72/482.91; 72/462

[58] Field of Search ..... 72/389, 462, 481, 72/482

[56] References Cited

U.S. PATENT DOCUMENTS 4,993,255 2/1991 Treillet .

FOREIGN PATENT DOCUMENTS

| | | |
|---|---|---|
| 0387121 | 9/1990 | European Pat. Off. . |
| 2609909 | 7/1988 | France . |
| 3136440 | 3/1983 | Germany . |
| 62-267019 | 11/1987 | Japan . |
| 5317973 | 12/1993 | Japan . |
| 0623436 | 2/1994 | Japan . |

*Primary Examiner*—David Jones
*Attorney, Agent, or Firm*—Greenblum & Bernstein

[57] ABSTRACT

An upper tool (9) for a press brake, the upper tool being clamped to a supported body (5) mounted on an upper table (3) by a clamping force of a pressing-down and fixing member (11), includes: a shank to be clamped being formed with an inclined surface (9*c*) for gradually increasing the clamping force of the pressing-down and fixing member (11) to the upper tool (9) by relative movement of the upper tool (9) to the support body (5).

19 Claims, 10 Drawing Sheets

UPPER TOOL FOR PRESS BRAKE

This application is a continuation-in-part of Ser. No. 08/239,323, filed May 6, 1994, which is expressly incorporated by reference herein in its entirety.

BACKGROUND OF THE INVENTION

1. Field of the Invention

The present invention relates to an upper tool for a press brake, and more specifically to an upper tool for a press brake which can be easily exchanged for the upper table. In more detail, it relates to an upper tool capable of operating an upper tool holder so as to increase a clamping force when the upper tool is attached to the upper tool holder.

2. Description of the Related Art

As is well known, a press brake is provided with an upper table (referred to as an upper apron, sometimes) and a lower table (referred to as a lower apron, sometimes) arranged in such a way as to be opposed to each other, and either of the upper or lower table is disposed movably in the vertical direction.

To bend a plate like workpiece for instance, an upper tool is mounted on the lower part of the upper table, and a lower tool is mounted on the upper part of tile lower table. Therefore, when the movable side table is moved up and down so that the upper and lower tools can be engaged with each other, a workpiece positioned between the upper and lower tools is to be bent.

Further, in the above-mentioned press brake, a number of upper tool holders are mounted on the lower part of the upper table to exchange the upper tool with an appropriate one according to the bending shape of the workpiece. In other words, the upper tools are supported by a number of upper holders so as to be exchanged.

In the prior art upper tool holder, the structure is such that an upper-tool pressing-down and fixing member is mounted on a holder body attached to the lower part of the upper table, and the upper-tool pressing-down and fixing member is fastened with fastening bolts to tightly fasten and fix the upper part of the upper tool between the holder body and the upper tool clamp.

Therefore, when the upper tool is required to be exchanged with another one, since a number of fastening bolts provided for a number of upper tool holders must be loosened, there exists a problem in that the exchanging work of the upper tool is extremely complicated and therefore troublesome.

To overcome the above-mentioned problem, a structure such that air cylinders are mounted on the upper tool holders to fasten and loosen the upper-tool pressing-down and fixing members has been developed.

In the above-mentioned structure, however, since an air cylinder must be provided for each of a number of the upper tool holders and additionally an air source is required, there raises another problem in that the structure is further complicated and therefore costly.

Further, in the prior art structure, there exists such an danger that when the pressing-down and fixing of the upper tool by means of the upper-tool pressing-down and fixing member is loosened, the upper tool drops. Further, when the upper tool is mounted on the upper tool holder, the upper-tool pressing-down and fixing member must be fastened tightly under the conditions that the upper-tool pressing-down and fixing member is fastened slightly to such an extent that the upper tool will not drop and thereafter the upper and lower tools are aligned with respect to each other, thus causing a problem in that the upper tool exchanging work is troublesome.

Additionally, E.P. Pat. No. 0387121A1 discloses a tool in connection with the present upper tool. In this prior art, an upper tool is fastened with a holder body through an upper-tool clamping member pivotably mounted to an upper table of a press brake. The detachment and attachment of the upper tool are attained by rotating the clamping member so as to avoid a pivot axis about which the member is pivoted. Therefore, an operation that an operator rotates the upper tool, supporting an molding die of 20~30 kg in weight by his hand, is extremely dangerous for his waist and hands.

Furthermore, in case of arranging a plurality of upper tools in order along the longitudinal direction in the upper tool holder, there is caused a problem that it is impossible to attach a sequent upper tool to the upper-tool clamping member in which the other upper tool has already clamped, in the longitudinal direction of the upper tool.

SUMMARY OF THE INVENTION

With these problems in mind, therefore, it is an object of the present invention to provide an upper tool for a press brake, which can be easily exchanged in an upper tool holder and in addition which can prevent the upper tool from being dropped even if the upper tool is released from an upper tool clamp of an upper tool holder.

To achieve the object, according to the present invention, an upper tool for a press brake, clamped to a supported body mounted on an upper table by a clamping force of a pressing-down and fixing member, comprises: a shank to be clamped being formed with an inclined surface for gradually increasing the clamping force of the pressing-down and fixing member to the upper tool by relative movement of the upper tool to the support body.

Further, according to present invention, there is also provided an upper tool for a press brake, by relative rising of the upper tool with respect to a holder body of the press brake, the upper tool being pressed down and fixed to the holder body by a repulsive force of an upper-tool clamping member pivotably mounted to the holder body, the upper tool comprising: a slanted surface for pivoting the upper-tool clamping member during the relative rising, the slanted surface being provided at a part of the upper tool opposite to the upper-tool clamping member.

In the present Invention, the slanted surface is slanted with an inclination angle of 5~20°, and more preferably, 7~11° to a vertical direction.

Preferably, the upper tool is provided on a downside of the slanted surface with an engaging groove for engaging with an engaging projection formed in the upper-tool clamping member.

In the present invention, preferably, the holder body is provided with a support plate and the upper tool is provided with a contact surface which is capable of coming into contact with a lower end surface of the support plate and which is arranged to be lower than a lower surface of the engaging groove. Further, an upper surface of the engaging groove is formed to be slanted slightly to a direction perpendicular to the vertical direction.

Preferably, a vertical surface is formed between the slanted surface and the engaging groove.

According to present invention, there is also provided an upper tool for a press brake, the upper tool being detachable mounted between a support plate and a upper-tool clamping member, the support plate being arranged on a lower part of a holder body in an upper tool holder attached on an underside of an upper table of the press brake, the upper-tool clamping member being pivotably mounted to the holder body and being constructed to be capable of pressing the upper tool against the support plate, the upper tool comprising:

a contact surface which is capable of contacting with a lower end surface of the support plate;

a sliding surface which is capable of sliding on a front surface or a rear surface of the support plate;

a slanted surface for pivoting the upper-tool clamping member to increase a clamp force of the upper tool due to the upper-tool clamping member in case of rising the upper tool relatively with respect to the support plate to contact the contact surface with the lower end surface of the support plate; and a processed part for cooperating with the lower tool of the press brake to process a work;

wherein, in a condition under which an upper surface of the engaging groove provided in the upper tool is supported by an engaging projection provided in the upper-tool clamping member, a distance H between the the lower end surface of the support plate and the contact surface of the upper tool can be calculated by a following expression:

$$H=(B^2 \cdot P)/(A^2 \cdot k \cdot \tan\theta)$$

wherein A: a dimension of distance from a pivot center of the upper-tool clamping member through an elastic means for pressing the member;

B: a mean distance from the pivot center through a pressing point at which the upper-tool clamping member presses the upper tool against the support plate;

P: a pressing force by which the upper tool is pressed against the support plate;

K: an elastic coefficient of the elastic means; and

θ: a slant angle of the slanted surface.

In the above mentioned arrangement, by positioning an upper part of the upper tool between the support plate and the pivotable upper-tool clamping member and by engaging the engaging groove with the engaging projection of the upper-tool clamping member, thereby rising the upper tool with respect to the support plate relatively, the lower part of the upper-tool clamping member is pressed by the slanted surface of the upper tool, so that a distance between the lower part and the support plate is expanded forcefully. Therefore, since the clamp force derived from a repulsive force at that time is gradually increased, the clamping operation of the upper tool can be attained certainly.

When the clamp force is released, an upper surface of the engaging projection of the upper-tool clamping member is engaged with an upper surface of the engaging groove of the upper tool, whereby it is possible to prevent the upper tool from falling.

Consequently, it is possible to accomplish the exchange of upper tool against the upper tool holder without a tool, easily and safely.

DETAILED DESCRIPTION OF THE PREFERRED EMBODIMENTS

The embodiments of the present invention will be described hereinbelow with reference to the attached drawings.

Figure 1:
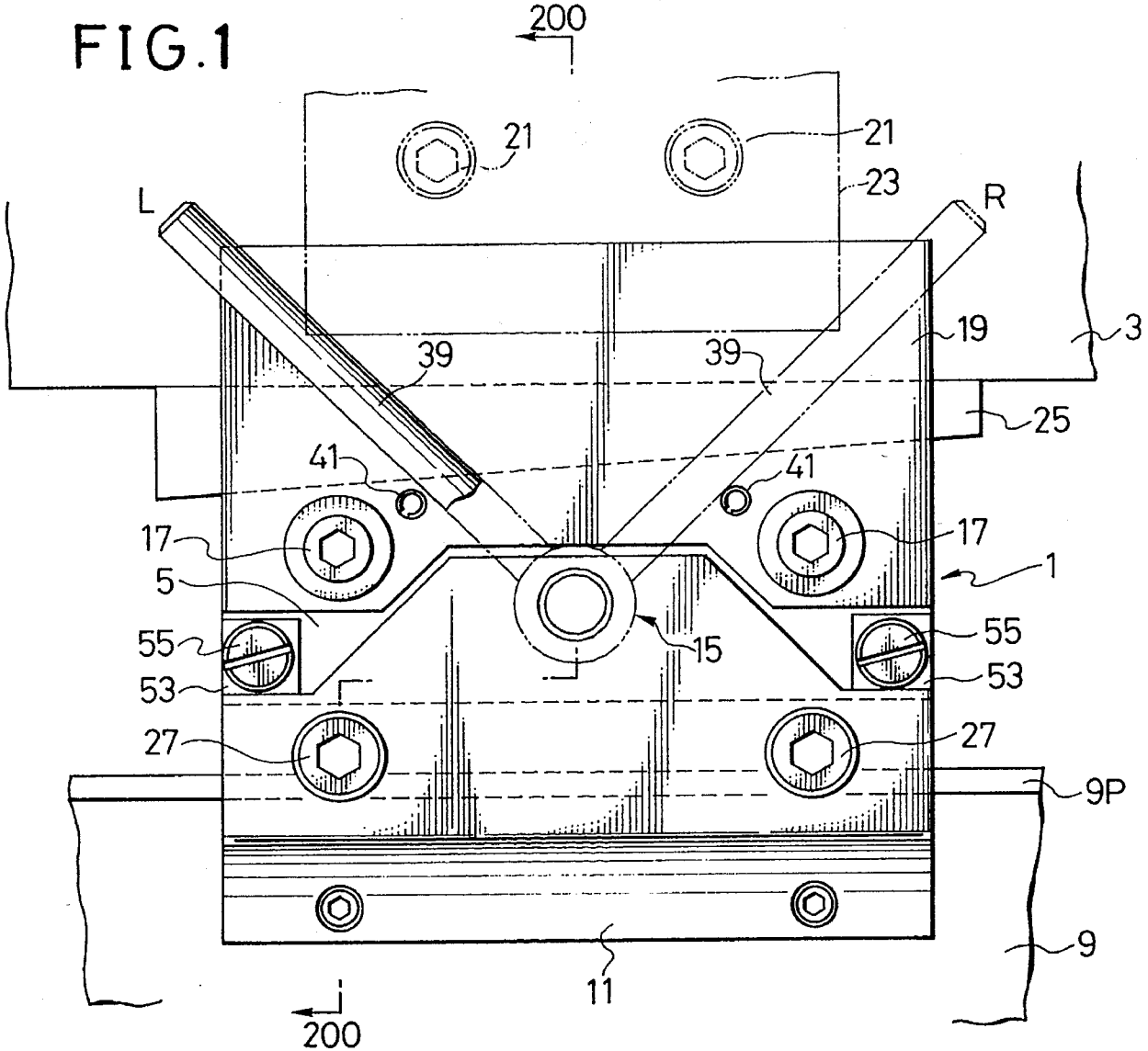
FIG. 1 is a front view showing a first embodiment of the upper holding device of the present invention.
Figure 2:
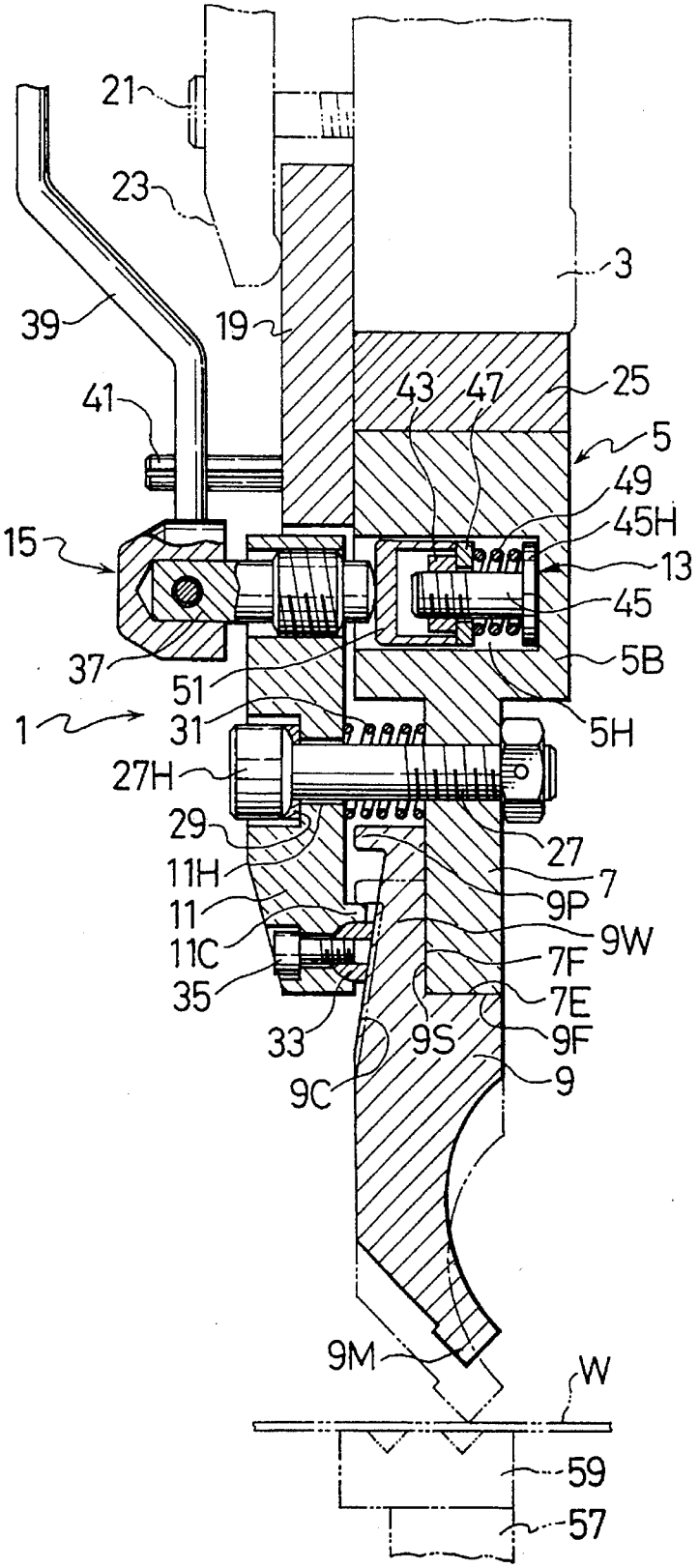
FIG. 2 is a cross-sectional view taken along the lines 200—200 shown in FIG. 1.

In FIGS. 1 and 2, the upper holding device related to the first embodiment includes a holder body 5 removably mounted on the lower part of an upper table 3 of a press brake (not shown); a support plate 7 formed integral with the lower part of the holder body 5; an upper-tool pressing-down and fixing member 11 for pressing-down and fixing an upper tool 9 between the upper-tool pressing-down and fixing member 11 and the support plate 7; a clamping-force producing device 13 for producing the clamping force of the upper-tool pressing-down and fixing member 11, and a clamp releasing device 15 for releasing the upper tool 9 from the upper-tool pressing-down and fixing member 11.

In more detail, the holder body 5 is formed with an upper block portion 5B having a thick wall in the front and rear direction (in the right and left direction in FIG. 2). The support plate 7 is formed integral with the lower part of the upper block portion 5B. To the front surface (on the left side in FIG. 2) of the upper block portion 5B of the holder body 5, a mounting plate 19 projecting upward is mounted with the use of a plurality of bolts 17 (see FIG. 1).

The holder body 5 can be mounted on the upper table 3 by bringing the mounting plate 19 into contact with the front lower portion of the upper table 3 and by fastening a clamp jaw 23 with the use of fastening bolts 21 screwed into the upper table 3.

A wedge member 25 is interposed between the upper surface of the holder body 5 and the upper table 3 to adjust the vertical position of the holder body 5.

In the structure as described above, under the condition that the clamp Jaw 23 is slightly fastened against the mounting plate 19 to such an extent that the holder body 5 will not drop, it is possible to adjust the vertical position of the holder body 5 finely in the downward direction by striking the wedge member 25 slightly.

The upper-tool pressing-down and fixing member 11 is formed with a plate-shaped member having a width roughly the same as that of the holder body 5 in the right and left direction in FIG. 1, and pivotally supported by the holder body 5 so as to fix the upper tool 9 In cooperation with the support plate 7.

In more detail, the upper-tool pressing-down and fixing member 11 is formed with through holes 11H at roughly the middle portion (in the vertical direction) thereof (see FIG. 2), and pivotally supported by a plurality of mounting bolts 27 passed through the through holes 27H and screwed in the horizontal direction into the support plate 7. To facilitate the pivotal motion thereof, a spherical washer 29 is interposed between a head portion 27H of each of the mounting bolts 27 and the upper-tool pressing-down and fixing member 11. In addition, a weak coil spring 31 is elastically disposed between the upper-tool pressing-down and fixing member 11 and the support plate 7 so that the two members 11 and 7 are urged to be away form each other.

On the lower portion of the upper-tool pressing-down and fixing member 11, two pressing-down and fixing sections 11C are projectingly formed to press the upper tool 9 against the support plate 7 for clamping the upper tool 9. In addition, a push member 33 for pressing the upper tool 9 is mounted on the pressing-down and fixing section 11C with a bolt 35.

The clamp releasing device 15 is provided on the upper portion of the upper-tool pressing-down and fixing member 11 to release the upper tool 9 clamped by the pressing-down and fixing section 11C of the upper-tool pressing-down and fixing member 11.

The clamp releasing device 15 includes a fastening screw 37 screwed into the upper portion of the upper-tool pressing-down and fixing member 11, and a lever 39 is attached to this fastening screw 37.

Accordingly, when the lever 39 is pivoted, it is possible to fasten and unfasten the fastening screw 37. Further, to limit the operational (pivotal) range of the lever 39, two right and left limit pins 41 are implanted on the mounting plate 19.

The clamping-force producing device 13 includes an adjust screw 45 engaged with a nut member 43 for relative positional adjustment, a ring member 47 fitted to the adjust screw 45 so as to be movable in the axial direction, a strong elastic member 49 (a coil spring or a disk spring or urethane rubber) elastically interposed between the head portion 45H of the adjust screw 45 and the ring member 47, as shown in FIG. 2. The clamping-force producing device 13 is disposed in a horizontal inner hollow portion 5H formed in the upper block portion 5B of the holder body 5.

In the above-mentioned structure, it is possible to adjust the elastic force (the compressive condition) of the elastic member 49 by adjusting the engage position between the adjust screw 45 and the nut member 43.

Further, a contact member 51 in contact with the front end portion of the fastening screw 37 is formed integral with the ring member 47. A head portion 45H of the adjust screw 45 is in contact with the side wall of the hollow portion 5H.

In the structure as described above, under the condition that the upper tool 9 is clamped between the support plate 7 of the holder body 5 and the upper-tool pressing-down and fixing member 11 as shown in FIG. 2, when the lever 39 of the clamp releasing device 15 is pivoted clockwise to a position R in FIG. 1 to fasten the fastening screw 37, because of the elastic member 49 being further compressed, the elastic force of this elastic member 49 is further increased, so that it is possible to fasten the upper tool 9 by a still stronger fastening force.

In contrast with this, when the lever 39 is pivoted counterclockwise to a position L in FIG. 1 to unfasten the fastening screw 37, it is possible to release the fixed upper tool 9 from the fixed condition.

As described above, when the lever 39 is pivoted to fix or release the upper tool 9, the upper-tool pressing-down and fixing member 11 is pivoted in the right and left directions in FIG. 2 on the mounting bolts 27 acting as pivot centers.

As shown in FIG. 1, a plurality of small piece members 53 are attached to the holder body 5 with bolts 55 so as to be brought into contact with the upper surface of the upper-tool pressing-down and fixing member 11, in order to guide the pivotal motion of the upper-tool pressing-down and fixing member 11 and further to restrict the upward movement of the upper-tool pressing-down and fixing member 11. Accordingly, the upper-tool pressing-down and fixing member 11 can press down and fix the upper tool 9 without moving in the vertical direction.

As shown in FIG. 2, the upper tool 9 exchangeably mounted on the upper holding device 1 as described above is formed with a wedge portion 9W having a contact surface 9F brought into contact with a lower end surface 7E of the support plate 7, a sliding surface 9S brought into slidable contact with a front surface 7F of the support plate 7, and a clamp surface 9C brought into tight contact with the push member 33 of the upper-tool pressing-down and fixing member 11.

The wedge portion 9W is so formed as to provide a thin walled portion in the upward direction by forming the clamp surface 9C as an inclined surface. Further, the wedge portion 9W is formed with a projection portion 9P engagable with the pressing-down and fixing section 11C of the upper-tool pressing-down and fixing member 11.

Further, the upper tool 9 is formed with a lower end work processing portion 9M for bending a workpiece W in cooperation with a lower tool 59 mounted on a lower table-57 of the press brake.

In the structure as described above, the upper tool 9 is mounted on the upper tool holding device 1 in accordance with the following procedure:

First, the lever 39 of the clamp releasing device 15 is pivoted in the clockwise direction to hold the fastening screw 37 in the fastened condition. Even under the condition that the fastening screw 37 is fastened as described above, the push member 33 formed at the lower portion of the upper-tool pressing-down and fixing member 11 is kept away from the support plate 7.

Accordingly, as shown by phantom lines in FIG. 2, it is possible to insert the upper thin walled portion of the wedge portion 9W of the upper tool 9 into between the support plate 7 and the upper-tool pressing-down and fixing member 11 in the horizontal direction so that an upper projection portion 9P of the upper tool 9 is engaged with the pressing-down and fixing section 11C of the upper-tool pressing-down and fixing member 11.

Thereafter, the movable side of the upper or lower table 3 or 57 is moved up and down to engage the upper tool 9 with the lower tool 59, with the result that the upper tool 9 is moved upward relative to the holder body 5.

When the upper tool 9 is relatively moved gradually toward the holder body 5, because of the push member 33 of the upper-tool pressing-down and fixing member 11 being pushed toward the left in FIG. 2 by the inclined clamp surface 9C of the upper tool 9, the upper-tool pressing-down and fixing member 11 is pivoted in the clockwise direction in FIG. 2, so that the elastic member 49 of the clamp force adjusting device 13 is compressed gradually.

Accordingly, when the contact surface 9F of the upper tool 9 is brought into contact with the lower end surface 7E of the support plate 7, it is possible to obtain such a condition that the wedge portion 9W of the upper tool 9 is fastened and fixed strongly by the upper-tool pressing-down and fixing member 11 which is urged in the counterclockwise direction by the elastic force of the elastic member 49. Therefore, it is possible to easily mount the upper tool 9 on the upper tool holding device 1.

The upper tool 9 can be removed from the upper tool holding device 1 as follows:

First, the lever 39 of the clamp releasing device 15 is pivoted in the counterclockwise direction to loosen the fastening force of the fastening screw 37, so that the upper tool 9 is released from the upper-tool pressing-down and fixing member 11. When the fastened condition of the upper tool 9 is released and therefore the upper tool 9 is moved downward by its weight, the projection 9P of the wedge portion 9W of the upper tool 9 is engaged with the clamp portion 11C of the upper-tool pressing-down and fixing member 11, so that it is possible to prevent the upper tool 9 from being dropped.

As described above, under the condition that the upper tool 9 is released from the fastening or fixed condition, when the upper tool 9 is moved in the horizontal direction, it is possible to easily remove the upper tool 9 from the upper tool holding device 1.

In other words, in the embodiment according to the present invention, it is possible to easily exchange the upper tool 9 clamped by the upper holding device 1 with another upper tool, in spite of such a simple structure as described above, without use of any tools.

Figure 3:
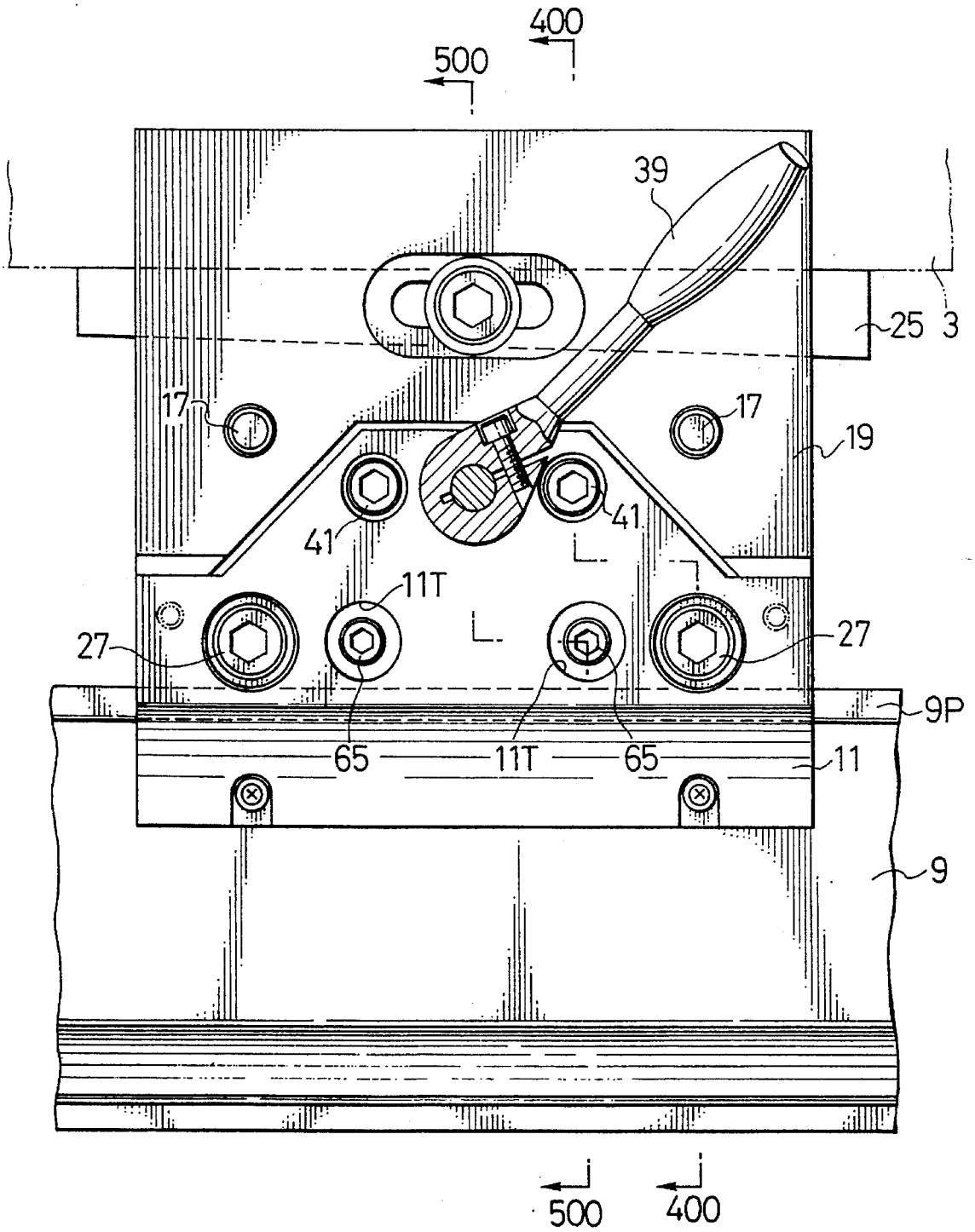
FIG. 3 is a front view showing a second embodiment of the upper holding device of the present invention.
Figure 4:
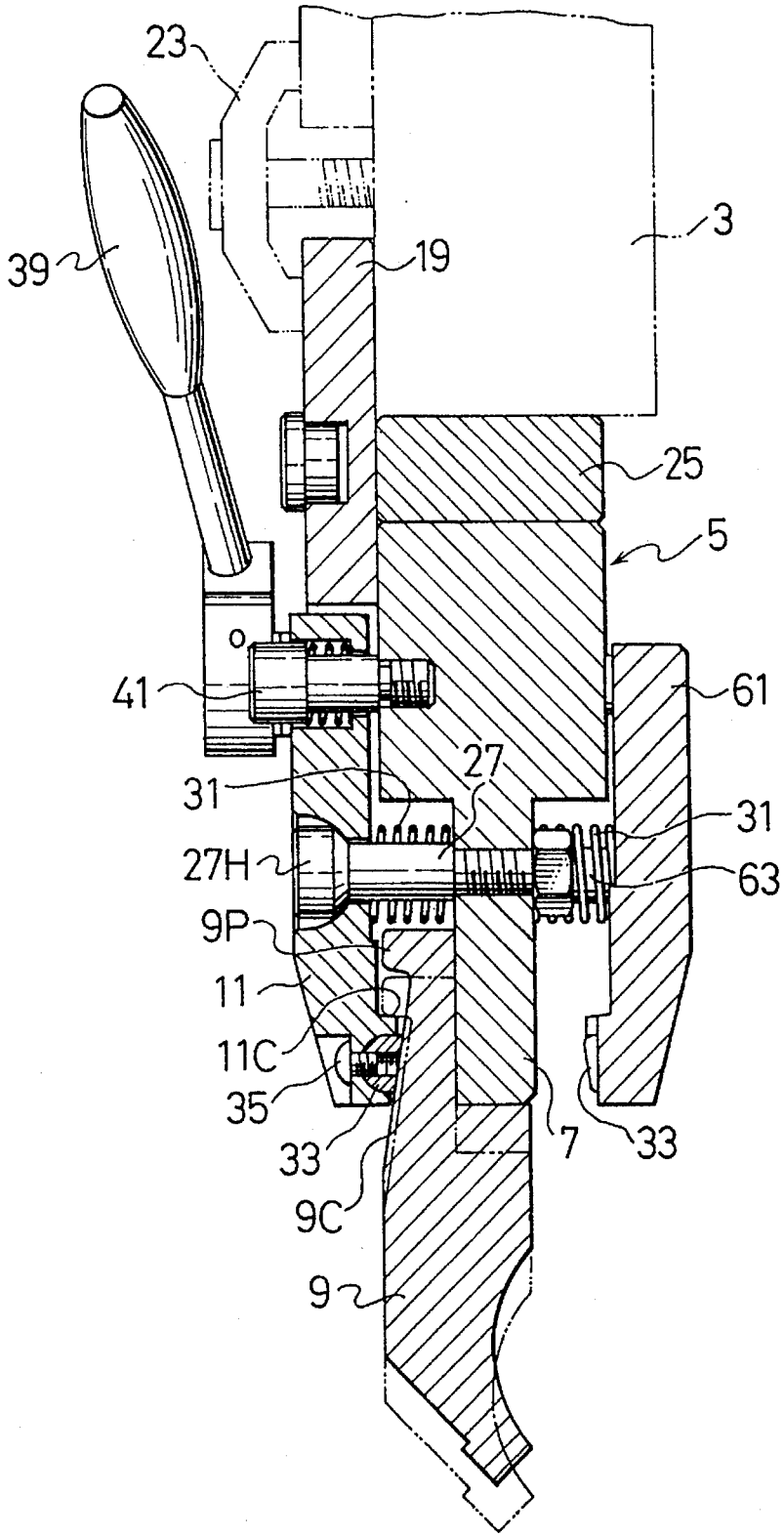
FIG. 4 is a cross-sectional view taken along the line 400 to 400 shown in FIG. 3.

A second embodiment of the upper tool holding device 1 according to the present invention will be described hereinbelow with reference to FIGS. 3 to 5. In this second embodiment, another upper tool 9 can be further clamped on the rear surface of the support plate 7.

Therefore, the same reference numerals have been retained for the similar element or parts which have the same functions as with the case of the first embodiment, without repeating any detailed description thereof, and only the points different from the first embodiment will be explained hereinbelow.

A point different from the first embodiment is that a rear-side upper-tool pressing-down and fixing-member 61 is attached to the rear surface of the support plate 7 in order to clamp the other upper tool 9 on the rear surface of the support plate 7.

Figure 5:
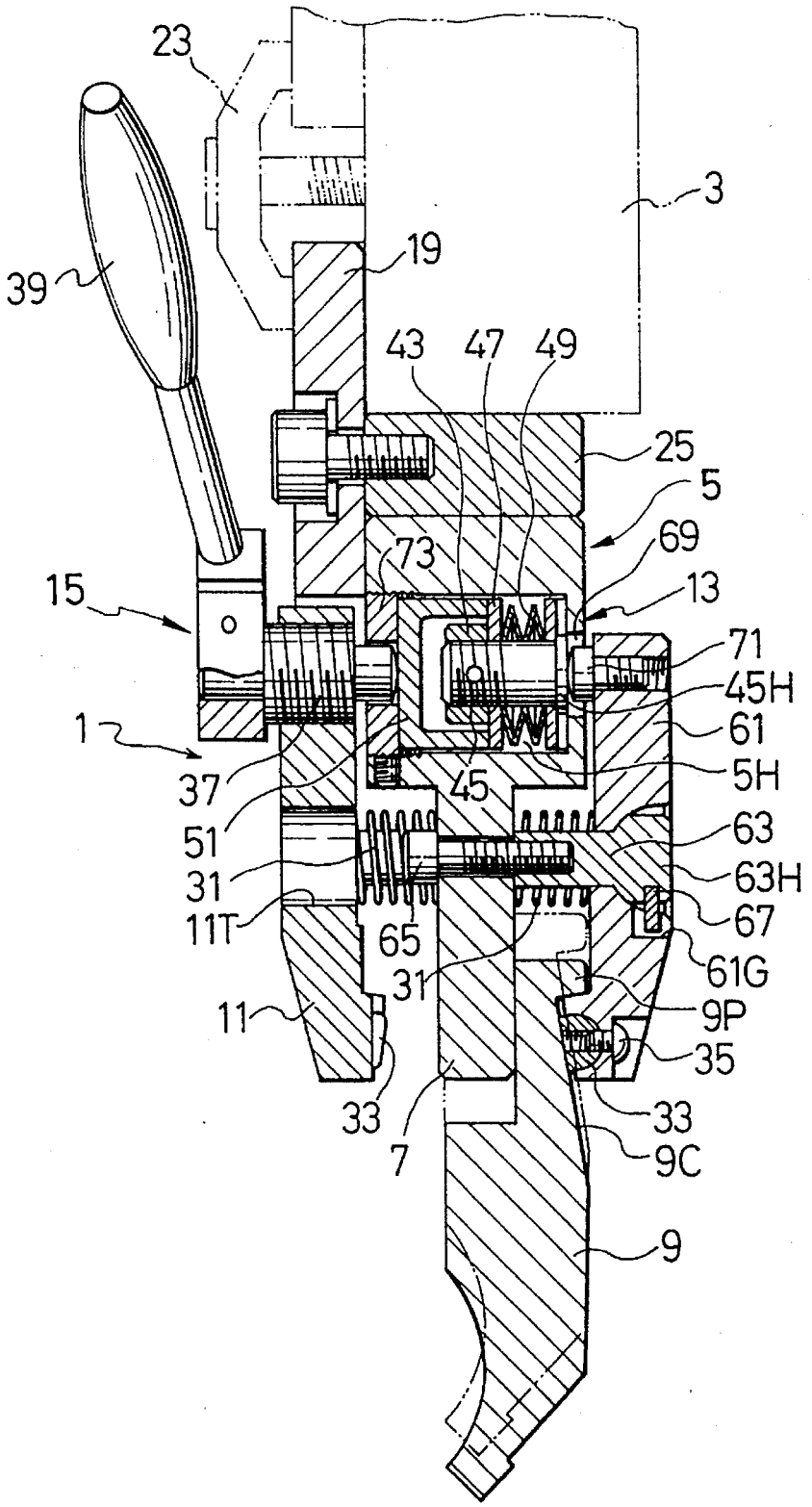
FIG. 5 is a cross-sectional view taken along the line 500—500 shown in FIG. 3, in which an upper tool is mounted on the rear side.

In more detail, in FIG. 5, a stud 63 formed with a semispherical head portion 63H is attached horizontally to the rear surface of the support plate 7 of the holder body 5 with the use of a mounting bolt 65. The rear-side upper-tool pressing-down and fixing member 61 is pivotally supported by this stud 63.

To mount the stud 65, the front side upper-tool pressing-down and fixing member 11 is formed with a tool hole 11T, and a locking pin 67 engaged with a groove 61G formed in the rear-side upper-tool pressing-down and fixing member 61 is attached to the head portion 63H of the stud 63. Accordingly, when the mounting bolt 65 is rotated, the stud 63 will not be rotated.

In order to use the clamping-force producing device 13 in common for both the front-side upper-tool pressing-down and fixing member 11 and the rear-side upper-tool pressing-down and fixing member 61, the clamping-force producing device 31 is housed in the holder body 5, and a small diameter hole 69 is formed in the rear wall of an Inner hollow portion 5H. Further, a contact member 71 mounted on the upper portion of the rear-side upper-tool pressing-down and fixing member 61 is passed through the small diameter hole 69 so as to be brought into contact with a head portion 45H of an adjust screw 45.

Further, a ring nut 73 is screwed into left side (in FIG. 5) of the inner hollow portion 5H in order to restrict the movement of the contact member 51 of the clamp adjusting device 13.

In the second embodiment as described above, when the mounting bolt 65 is fastened, it is possible to tightly fasten the upper tool 9 between the rear side of the support plate 7 and the rear-side upper-tool pressing-down and fixing member 61. When the mounting bolt 65 is loosened, the upper tool 9 can be released from the fastened condition by the rear-side upper-tool pressing-down and fixing member 61.

Further, in the case where the front-side upper-tool pressing-down and fixing member 11 is kept under the condition that an appropriate member is sandwiched between the support plate 7 and the lower end of the front-side upper-tool pressing-down and fixing member 11 (to hold the front-side upper-tool pressing-down and fixing member 11 at a fixed condition relative to the support plate 7), it is possible to fasten and release the upper tool 9 by use of the rear-side upper-tool pressing-down and fixing member 61 by operating the lever 39.

Therefore, in this second embodiment, two upper tools 9 can be fixed (both sides of each upper tool 9 are reversed) to the front and rear side surfaces of the support plate 7 of the holder body 5 according to the bending shape of the workpiece W, and in addition it is possible to exchange the upper tools 9 easily in the same way as with the case of the first embodiment.

As understood by the above-mentioned embodiments, in the upper tool holding device 1 according to the present invention, an upper tool-or upper tools 9 can be exchanged easily in spite of the simple structure, and in addition it is possible to prevent the upper tool 9 from being dropped even when the upper tool holding device 1 is released from the fixed upper tool 9, thus improving the safety of the press brake.

Next, a third embodiment of an upper tool according to the present invention will be described.

Figure 6:
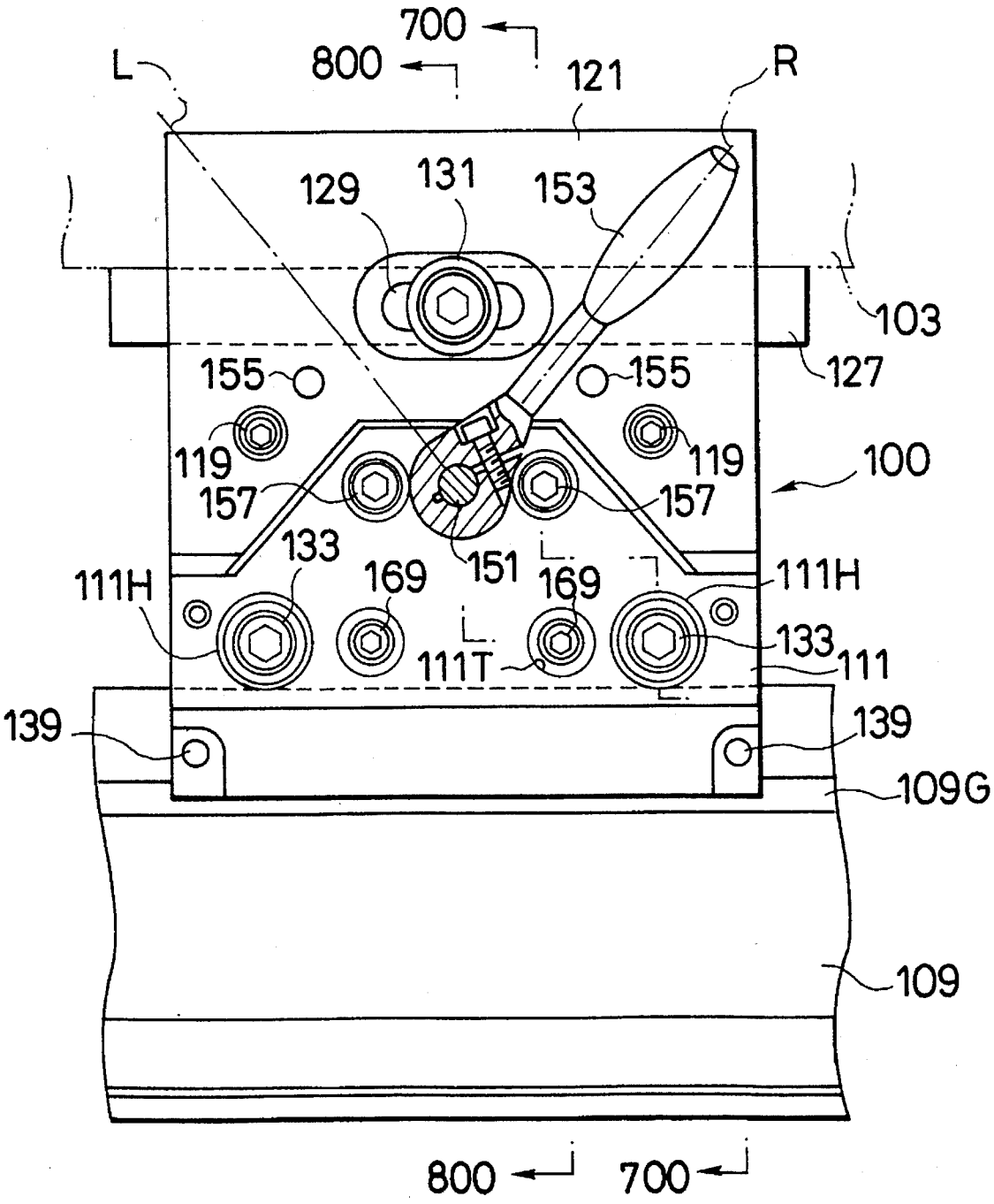
FIG. 6 is a front view showing a third embodiment of the upper tool holder of the present invention;.
Figure 7:
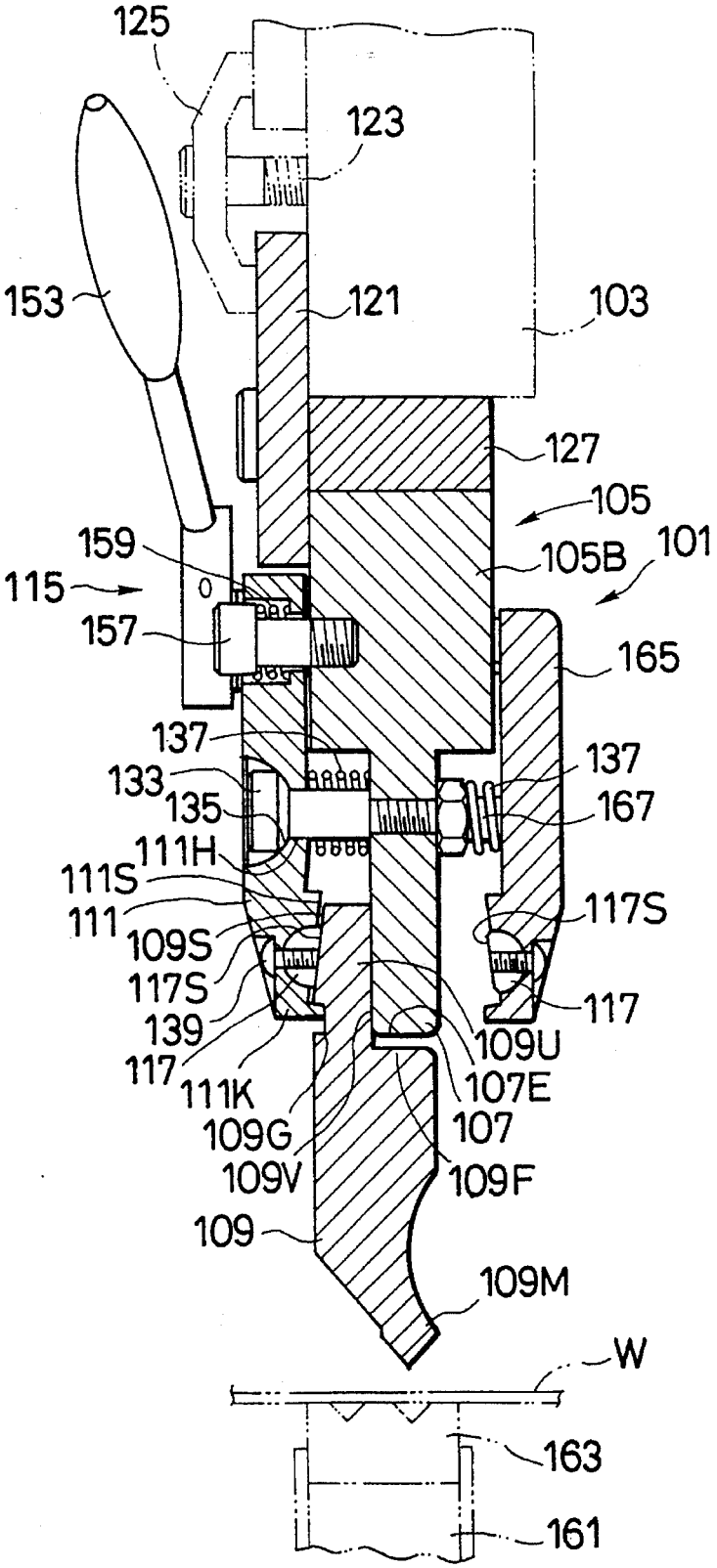
FIG. 7 is a cross-sectional view taken along the lines 700—700 shown in FIG. 6.
Figure 8:
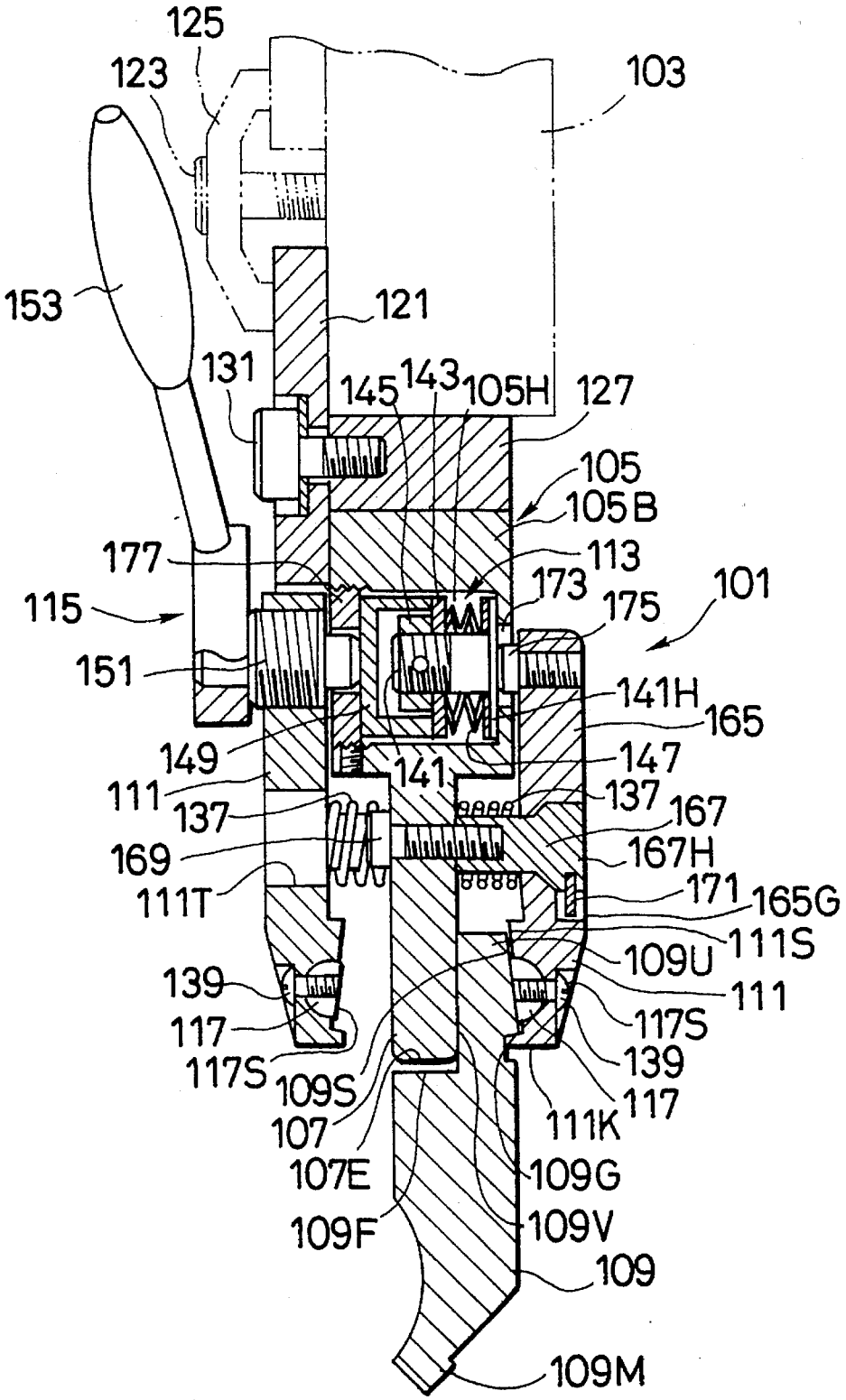
FIG. 8 is a cross-sectional view taken along the lines 800—800 shown in FIG. 6.

Referring to FIGS. 6 to 8, an upper tool holder 101 is detachably mounted to the lower part of an upper table 103 of a not-shown press brake.

The upper tool holder 101 includes a holder body 105 removably mounted on the lower part of the upper table 3; an upper-tool clamping member 111 pivotably mounted to the holder body 105 so as to press and fix an upper part 109U of the upper tool 109 to a support plate 107 formed integral with the lower part of the holder body 105; a clamp force adjusting device 113 for adjusting the clamp force of the upper-tool clamping member 111; and a clamp releasing device 113 for releasing the clamp of the upper tool 109 by the upper-tool clamping member 111. Further, a contact surface 117S which can contact with a slanted surface 109S, is formed in a contact member 117 rotatably mounted in a lower part of the upper-tool clamping member 111.

In more detail, the holder body 105 is formed with an upper block portion 105B having a thick wall in the front and rear direction (in the right and left direction in FIGS. 7 and 8). The support plate 107 is formed integral with the lower part of the upper block portion 105B. To the front surface (on the left side in FIG. 7) of the upper block portion 105B of the holder body 105, a mounting plate 121 projecting upward is mounted with the use of a plurality of bolts 119 (see FIG. 6).

The holder body 105 can be mounted on the upper table 103 by bringing the mounting plate 121 into contact with the front lower portion of the upper table 103 and by fastening a clamp jaw 125 with the use of fastening bolts 123 screwed into the upper table 103.

A wedge member 127 is interposed between the upper surface of the holder body 105 and the upper table 103 to adjust the vertical position of the holder body 105. A fixing bolt 131 penetrating an elongated hole 129 (see FIG. 6) formed in the mounting plate 121 is screwed into the wedge member 127.

In the structure as described above, under the conditions that the clamp Jaw 125 is slightly fastened against the mounting plate 121 to such an extent that the holder body 105 will not drop and that the fixing bolt 131 is loosen, it is possible to adjust the vertical position of the holder body 105 finely with respect to the upper table 103 by adjusting the wedge member 127 slightly in the left and right direction in FIG. 6.

The upper-tool clamping member 111 is formed with a plate-shaped member having a width roughly the same as that of the holder body 105 in the right and left direction in FIG. 6, and pivotably supported by the holder body 105 so as to press and fasten the upper part 109U of the upper tool 109 against the support plate 107.

In more detail, the upper-tool clamping member 111 is formed with a plurality of through holes 111H at roughly the middle portion (in the vertical direction) thereof, and pivotably supported by a plurality of mounting bolts 133 passed through the through holes 111H and screwed in the horizontal direction into the support plate 107. To facilitate the pivotal motion of the upper-tool clamping member 111, a spherical surface 135 Is formed in a surface of the upper-tool clamping member 111, which comes into contact with a head portion of each of the mounting bolts 133. In addition, an elastic member 137, such as a coil spring, a rubber material etc., is disposed between the upper-tool clamping member 111 and the support plate 107 so that the two members 11 and 7 are urged to be away form each other.

On the lower part of the upper-tool clamping member 111, a slanted surface 1118 is formed in such a manner that the upper part thereof approaches the support plate 107 in comparison with the lower part thereof. A contact member 117 is mounted in the slanted surface ills so that it can rotate slightly.

In detail, through holes are arranged on both left and right sides of the lower part of the upper-tool clamping member 111. The mounting bolts 139 screwed into the contact members 117 pass through the through holes, respectively. Since a clearance is provided between each through hole and each mounting bolt 139, the contact member 117 can rotate slightly with respect to the upper-tool clamping member 111.

Further, the upper-tool clamping member 111 is provided on the lower part of the contact member 117 with an engaging projection 111K which can removably engage with an engaging groove 109G which extends in the left and right direction of the upper tool 109.

Installed in a horizontal hole 105H formed in an upper block part 105B is a clamping-force adjusting device 113 for adjusting a clamping-force, which exerts the clamp force for clamping pressingly the upper tool 109 against the support plate 107 through the intermediary of the upper-tool clamping member 111.

In detail, as shown in FIG. 8, the clamping-force adjusting device 113 includes a nut member 145 which is threadably engaged with an adjusting screw 141 for adjusting the position of a ring member 143 removably engaging with the adjusting screw 141, and an elastic member 147, such as a spring, which is elastically arranged between the head part 141H of the adjusting screw 141 and the ring member 143.

In the above-mentioned structure, it is possible to adjust the elastic force (the compressive condition) of the elastic member 147 by adjusting the engaging position of the nut member 145 with the adjusting screw 141 and by controlling the compression of the elastic member 147.

In the clamping-force adjusting device 113, the head part 141H of the screw 141 comes into contact with a retired wall of the hole 105H. A cylindrical press member 149 containing the nut member 145 therein comes into contact with the ring member 143.

Further, a tip end of a fastening screw 151 of the clamp releasing device 115, which is arranged on the upper part of the upper-tool clamping member 111, comes into contact with the press member 149. In detail, the clamp releasing device 115 includes the fastening screw 151 which passes through the upper part of the upper-tool clamping member 111 and on which a lever 153 is integrally mounted.

Therefore, it is possible to fasten and loose the fastening screw 151 by operating the lever 153. In order to limit an operative range (rotation range ) of the lever 153, the mounting plate 121 is provided on both sides thereof with stop-pins 155.

In the structure as described above, under the condition that the upper part 109U of the upper tool 109 is clamped between the support plate 107 of the holder body 105 and the upper-tool clamping member 111, when the lever 153 of the clamp releasing device 115 is pivoted clockwise to a position R in FIG. 6 to fasten the fastening screw 151, because of the elastic member 147 being further compressed, the elastic force of this elastic member 147 is further increased, so that it is possible to fasten the upper-tool clamping member 111 to the upper tool 9 by a repulsive force of the increased elastic force.

In contrast with this, when the lever 153 is pivoted counterclockwise to a position L in FIG. 6 to loose the fastening screw 151, it is possible to release the fixed upper tool 109 from the fixed condition.

As described above, when the lever 153 is pivoted to fix or release the upper tool 109, the upper-tool clamping member 111 is pivoted in the right and left directions in FIG. 7 on the mounting bolts 133 acting as pivot centers. A spring 159 is elastically installed between a plurality of bolts 157 screwed into the holder body 105 and the upper-tool clamping member 111 so that, when the fastening of the upper tool 109 is released, the lower part of the upper-tool clamping member 111 opens. Therefore, the upper-tool clamping member 111 in a position can fasten the upper tool 109.

Figure 9:
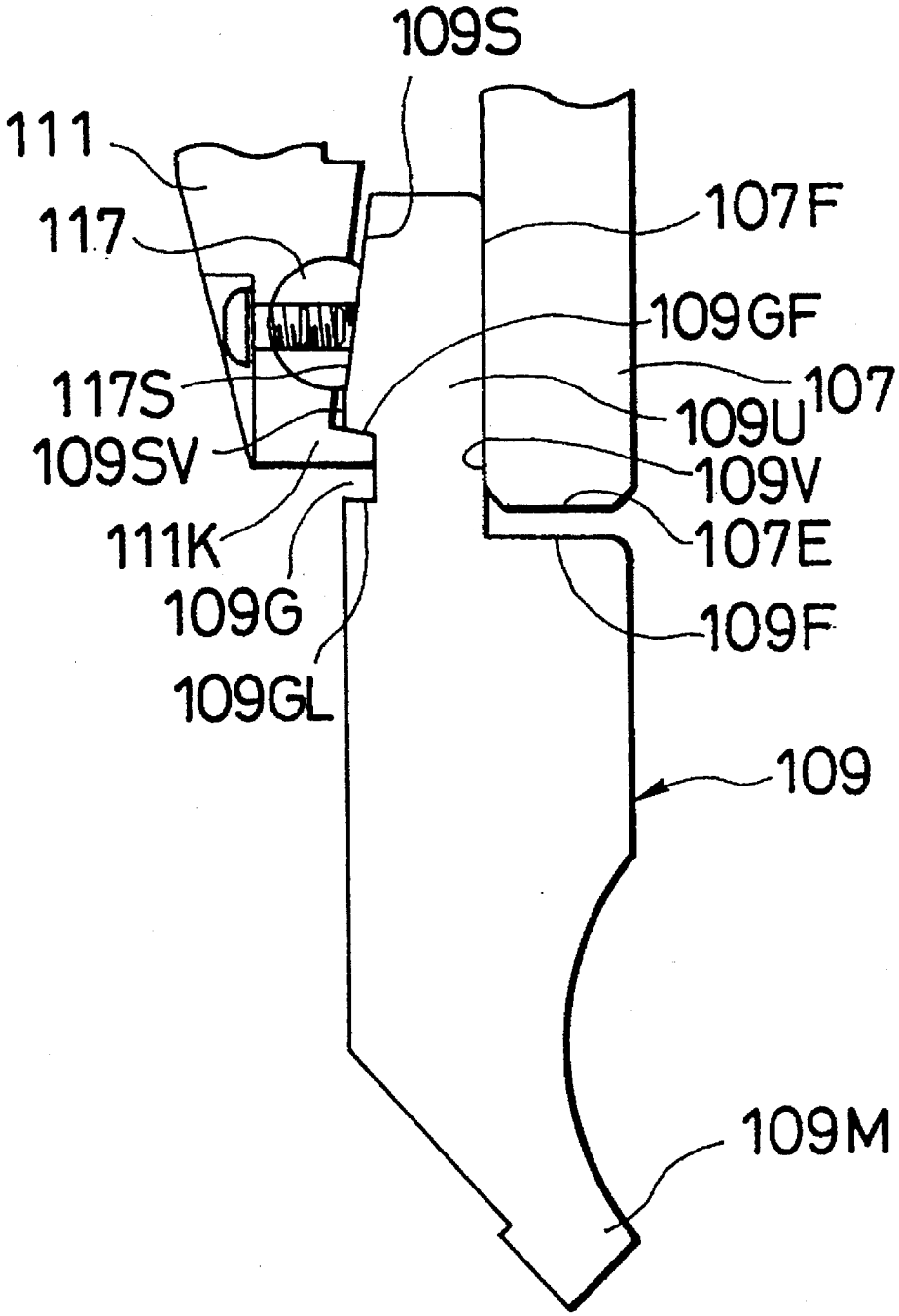
FIG. 9 is an enlarged view of the upper tool of FIG. 6.

As shown in FIG. 9, the upper tool 109 is provided with a contact surface 109F which is capable of being contact with a lower end surface of the support plate 107. Furthermore, the upper tool 109 has a sliding surface 109V which is capable of sliding on a front surface or a rear surface of the support plate 107. The engaging groove 109G is formed on a surface opposite to the sliding surface 109V. A vertical surface 109SV is arranged between the engaging groove 109G and the slanted surface 109S formed upward thereof. The vertical surface 109SV can provides a bearing surface in case of clamping the upper tool 109 by the general upper-tool clamping member.

In addition, the upper tool 109 has a processed part 109M for carrying out a bending operation of a work W ,in cooperation with a lower tool 163 fixed to a lower table 161 of the press brake.

As will be apparent from FIG. 9, the contact surface 109F is arranged to be lower than a lower surface 109GL of the engaging groove 109G. Further, an upper surface 109GF of the engaging groove 109G is formed to be slanted slightly to a transverse direction perpendicular to the vertical direction.

By the above-mentioned construction, since the lower end part of the upper-tool clamping member 111 is arranged to be higher than the lower end surface 107E of the support plate 107 and arranged to be relatively short, it is possible to prevent the member 111 from interfering with the work W in case of bending it with a sharp angle.

Further, since the engaging projection 111K of the upper-tool clamping member 111 comes into contact with the upper surface 109GF of the engaging groove 109G through their mutually slanted surfaces, the vertical sliding surface 109V of the upper tool 109 is always apt to be in contract with the support plate 107 under a condition that the upper tool 109 is supported.

Since the engaging groove 109G is positioned higher than the contact surface 109F, it is possible to increase a distance from a corner on which the contact surface 109F intersects the sliding surface 109V, whereby the strength can be increased in comparison with a case that the engaging groove 109G is level with the contact surface 109F.

In the structure as described above, under the condition that the upper tool 109 is removed from the upper holder 101, the former 109 can be attached to the latter 101 as follows:

First, the lever 153 of the clamp releasing device 115 is pivoted to a position R in FIG. 6 to fasten the fastening screw 151. In this way, even when the fastening screw 151 is tightened, there can be produced an opened space between the support plate 107 and the upper-tool clamping member 111.

Therefore, inserting the upper part 109U of the upper tool 109 between the support plate 107 and the upper-tool clamping member 111 from the left and right directions, the engaging groove 109G is engaged with the engaging projection 111K and the slanted surface 109S is in contact with the contact surface 117S.

Then, by moving the movable sides of the tables 103, 161 upwardly and downwardly to engage the upper tool 109 with a lower tool 161, the upper tool 109 can be rose relatively with respect to the holder body 105.

When the upper tool 109 rises relatively with respect to the holder body 105 in such a manner, the slanted surface 109S presses the lower end part of the upper-tool clamping member 111 through the contact member 117 to the left direction of FIGS. 7 and 9. Accordingly, the upper-tool clamping member 111 is gradually rotated in the counterclockwise direction of FIG. 7, thereby compressing the elastic member 147 in-the clamping-force adjusting device 113.

Therefore, when the contact surface 109F comes into contact with the lower end surface 107E of the support plate 107 by relative rising of the upper tool 109, there can be obtained a situation that the upper-tool clamping member 111 can clamp the upper tool 109 rigidly, due to the effect of elastic force derived from the elastic member 147. Consequently, it is possible to attach the upper tool 109 to the upper holder 101 easily.

As mentioned before, in order to remove the upper tool 109 from the upper holder 101, the lever 153 is pivoted to a position L in the counterclockwise direction , thereby loosening the fastening screw 151. Consequently, the tight fixing of the upper tool 109 by the upper-tool clamping member 111 is cancelled.

In this way, when the fixing is cancelled, the upper tool 109 falls to the original lower position (see FIG. 7) by its weight. Then, since the upper surface of the engaging groove 109G is supported by the engaging projection 111K, the upper tool 109 does not drop from the holder body 105 safely.

Under the condition that the fixing of the upper tool 109 is cancelled, by sifting it to either the left direction or the right direction, it enables the upper tool 109 to be removed from the upper-tool holder 101. That is, according to the embodiment, it is possible to carry out the easy exchange of the upper tool 109 for the other upper-tool without using any of implements.

Because of an arrangement where the clamping force of the upper tool 109 is gradually increased as the lower part of the upper-tool clamping member 111 is urged through the slanted surface 109S of the upper tool 109, the upper-tool clamping member 111 and the clamping-force adjusting device 113 etc. of the invention provides a so-called "clamping-force increasing mechanism" in which the clamping force can be increased by relative rising the upper tool 109 with respect to the support plate 107.

Although the upper tool holder 101 includes the clamping-force adjusting device 113 provided with the elastic member 147, as a constituent of the above mechanism, a hydraulic cylinder (ex. gas spring) containing compressed fluid (ex. gas) may be employed instead of the device 113. Further, assuming that the upper-tool clamping member 111 is consituted by a plate spring, thereby eliminating the device 13, the elastic deformation of the member 111 may be utilized for adjusting the clamping force. In this way, according to the invention, a variety of arrangements can be employed for the clamping-force increasing mechanism.

According to the embodiment, the upper tool holder 101 is so constructed as to be capable of attaching the reversed upper tool 109 to even the backside of the support plate 107. That is, in order to attach the reversed upper tool 109, the support plate 109 is provided on the backside thereof with a rear upper-tool clamping member 165.

In more detail, as shown in FIG. 8, a stud 167 formed with a semispherical head portion 167H is attached horizontally to the rear surface of the support plate 107 of the holder body 105 with the use of a mounting bolt 169. The rear upper-tool clamping member 165 is pivotably supported by this stud 167.

To mount the mounting bolt 169, the front upper-tool clamping member 111 is formed with a tool hole 111T, and a locking pin 171, which is engaged with a groove 165G formed in the rear upper-tool clamping member 165, is attached to the head portion 167H of the stud 167. Accordingly, when the mounting bolt 169 is rotated, the stud 167 will not be rotated.

In order to use the clamping-force adjusting device 113 in common for both the front upper-tool clamping member 111 and the rear upper-tool clamping member 165, a small diameter hole 173 is formed in the rear wall of an inner hollow portion 105H of the holder body 105. Further, a contact member 175 mounted on the upper portion of the rear upper-tool clamping member 165 is passed through the small diameter hole 173 so as to be brought into contact with a head portion 141H of an adjust screw 141.

Further, a ring nut 177 is screwed into the entrance side of the inner hollow portion 105H in order to restrict the movement of the press member 149 of the clamping-force adjusting device 113.

In the above-mentioned construction, when the mounting bolt 169 is fastened, it is possible to tightly fasten the upper tool 109 against the rear side of the support plate 107 by the rear upper-tool clamping member 61. When the mounting bolt 169 is loosened, the upper tool 109 can be released from the fastened condition by the rear upper-tool clamping member 165.

Further, in the case where the front upper-tool clamping member 111 is kept under the condition that an appropriate member is sandwiched between the support plate 107 and the front upper-tool clamping member 111 so as to hold the member 111 in an immovable condition with respect to the support plate 107, it is possible to fasten and release the upper tool 109 by use of the rear upper-tool clamping member 165 by operating the lever 153.

Therefore, according to the embodiment, it is possible to selectively fix the upper tool 109 to either the front side or the rear side of the support plate 107, corresponding to the bending shape of the workpiece W. In addition, it is possible to exchange the upper tool 109 for the other tool easily in the same way as with the case of the previous embodiments.

As understood by the above embodiment, in the upper tool holder 101 of the invention, the upper tool 109 can be exchanged easily in spite of the simple structure, and in addition it is possible to prevent the upper tool 109 from dropping even when the upper tool holder 101 is released from the fixed upper tool 109, thereby improving the safety of the press brake.

As mentioned before, the present invention employs the arrangement where the clamping force of the upper tool 109 is gradually increased as the lower part of the upper-tool clamping member 111 is urged through the slanted surface 109S of the upper tool 109 by relative rising it with respect to the support plate 107. Therefore, it is necessary that the sufficient clamping force can be obtained as the contact surface 109F of the upper tool 109 is brought into contact with the lower end surface 107E.

For this purpose, under the condition that the upper surface of the engaging groove 109G engages with the engaging projection 111K of the upper-tool clamping member 111, it is preferable that a distance H between the lower end surface 107E of the support plate 107 and the contact surface 109F of the upper tool 109 is calculated by a following expression:

$$H=(B^2 \cdot P)/(A^2 \cdot k \cdot \tan\theta)$$

wherein "A" is a dimension of distance from a pivot center of the upper-tool clamping member 111 through the elastic member 147 for pressing the member 111; "B" is a mean distance from the pivot center through a pressing point at which the upper-tool clamping member 111 presses the upper tool 109 against the support plate 107; "P" is a pressing force by which the upper tool 109 is pressed; and "θ" is an inclination angle of the slanted surface 109S.

Figure 10:
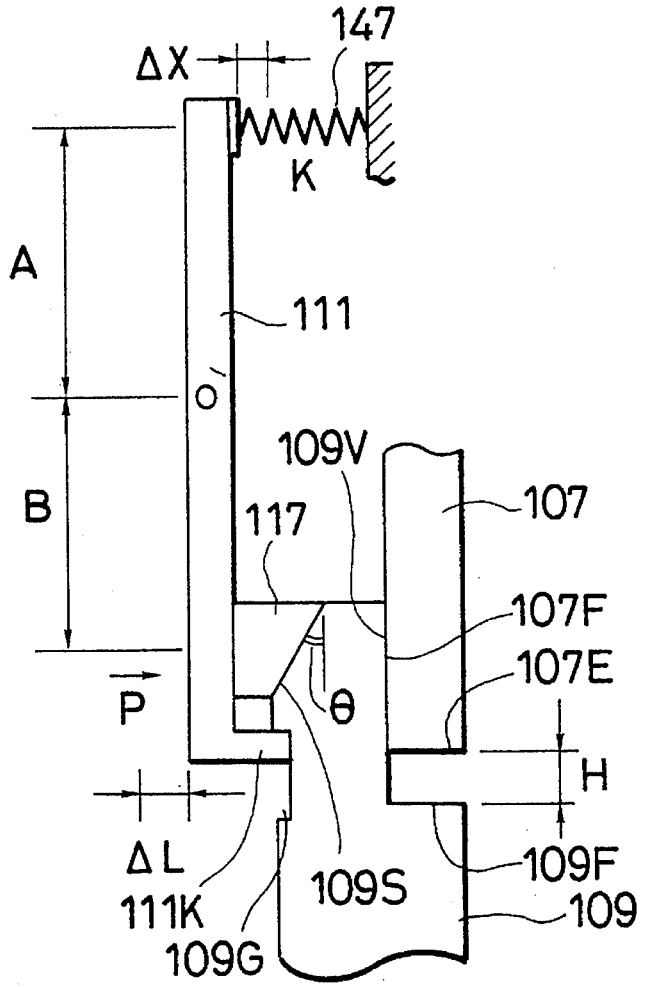
FIG. 10 is an explanatory view showing a relationship between the upper tool holder and the upper tool of the present invention.

Note that, an shown in FIG. 10, when the upper tool 109 rises relatively with respect to the support plate 107, the lower part of the member 111 displaces only ΔL while the upper part thereof does only ΔX to compress the elastic member 147, whereby the clamping force is gradually increased.

Under such a condition, if an actual distance is less than the distance H calculated by the above expression, the contact surface 109F of the upper tool 9 comes into contact with the lower end surface 7E of the support plate 107 because of the slight rising of the upper tool 109, so that the sufficient clamping force cannot be obtained. Accordingly, undesirably, there is a possibility of dropping of the upper tool 109.

On the contrary, in case that the actual distance is less than the calculated distance H, the displacement of the elastic member 147 becomes to be larger than the above ΔX, so that the large clamping force can be obtained. When the clamping of the tool 109 is cancelled by handling the lever 153, however, there is caused a possibility that the fixing of the upper tool 109 is not released sufficiently, so that it is difficult to attach or detach it to the upper tool holder 101, undesirably.

Therefore, it is preferable that the inclination angle θ of the slanted surface 109S is contained within a range of 5~20°. In case of less than 5° in the angle θ, it is necessary to establish the distance H of a large value in order to deform the elastic member 147. Conversely, in case of more than 20° in the angle θ, it is not desirable that a downward distribution force is increased, although the distance H may be of small value.

In order to prevent the upper tool 109 from dropping by its weight, it is necessary that a friction between the slanted surface 109S and the contact surface 117S becomes to be more than the weight of the upper tool 109 itself. The above friction, i.e., a maximum of static friction force, can be expressed as "static friction coefficient x direct pressure". And if the friction angle is of "θ", the above friction coefficient can be expressed as "tanθ".

Although the friction coefficient changes corresponding to surface conditions, such as surface roughness of the surfaces 109S and 117S, their materials, lubricating oil etc., it is desirable that the inclination angle θ of the slanted surface 109S is contained within a range of about 7~11° since the friction coefficient between the general metals can be regarded as 0.15~0.20.

It will be understood that the present invention is not limitative to the afore-mentioned embodiments, and that various changes and modifications may be made.

Figure 11:
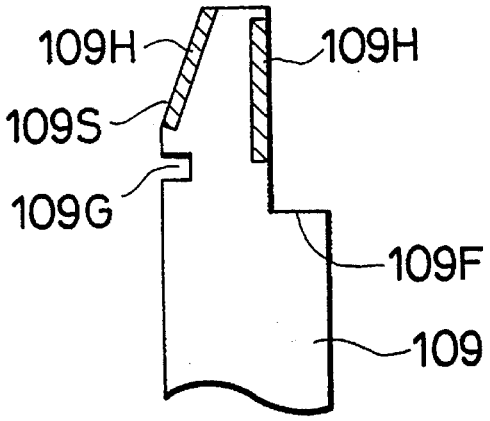
FIG. 11 is an explanatory view showing a modification of the upper tool of the present invention.

For example, as shown in FIG. 11, the slanted surface 109S and the sliding surface 109V may be provided with tips of alloy, respectively, in order to improve their friction resistance. Alternately, the part 109H may be hardened by an appropriate technique, such as coating, quenching etc.

As will be understood in the foregoing description, according to the present invention, by rising the upper tool relatively against the support plate of the upper tool holder, it is possible to easily attach or detach the upper tool to or from the upper tool holder having the increased clamping force therefor.

Furthermore, when the upper tool is attached to the upper tool holder, appropriate clamping force can be obtained, whereby it is possible to prevent the upper tool from dropping or sticking, thus improving the safety of the press brake.

What is claimed is:

1. An upper tool for a press brake mounted in an upper tool holder between a support plate and an upper-tool clamping member, said support plate being arranged on a lower part of a holder body in said upper tool holder attached on an underside of an upper table of said press brake, said upper-tool clamping member being pivotably mounted to said holder body and being capable of pressing said upper tool against said support plate, said upper tool comprising:

a contact surface which is capable of contacting with a lower end surface of said support plate;

a sliding surface which is capable of sliding on one of a front surface and a rear surface of said support plate; and a slanted surface for pivoting said upper-tool clamping member to increase a clamp force of said upper tool due to said upper-tool clamping member when said upper tool is raised with respect to said support plate, so as to decrease a distance H between said contact surface and said lower end surface of said support plate;

wherein, when an upper surface of said engaging groove is supported by an engaging projection provided in said upper-tool clamping member, said distance H between said lower end surface of said support plate and said contact surface of said upper tool can be calculated by a following expression:

$$H = (B^2 \cdot P)/(A^2 \cdot k \cdot \tan\theta)$$

wherein A represents a dimension of distance from a pivot center of said upper-tool clamping member through an elastic means for pressing said member;

B represents a mean distance from said pivot center through a pressing point at which said upper-tool clamping member presses said upper tool against said support plate;

P represents a pressing force by which said upper tool is pressed against said support plate;

K represents an elastic coefficient of said elastic means; and

θ represents a slant angle of said slanted surface, with respect to said sliding surface.

2. An upper tool for a press brake, said upper tool for attaching to an upper tool holding device mounted on an upper table of the press brake, said upper tool comprising:

a wedge shaped mounting portion, said mounting portion, positioned adjacent a first end of said upper tool and including:

a sliding surface;

a surface slanted with respect to said sliding surface, said slanted surface and said sliding surface gradually and continuously extend divergingly from said first end at an acute angle; and a contact surface, said contact surface extending substantially perpendicularly with respect to said sliding surface; and a work processing portion, said work processing portion positioned adjacent a second end of said upper tool.

3. The upper tool according to claim 2, said acute angle being approximately between 5° and 20°.

4. The upper tool according to claim 2, said acute angle being approximately between 7° and 11°.

5. The upper tool according to claim 2, said slanted surface extends from said first end to a position below, with respect to said first end, said contact surface.

6. The upper tool according to claim 2, said wedge portion further including a projecting portion, said projecting portion projecting from said first end and extending over said slanted surface.

7. The upper tool according to claim 2, said upper tool further comprising an engaging groove, said engaging groove extending inwardly from, and adjacent to, said slanted surface.

8. The upper tool according to claim 7, said contact surface being positioned between said work processing portion and said engaging groove.

9. The upper tool according to claim 7, said engaging groove formed at an end of said slanted surface opposite said first end.

10. The upper tool according to claim 7, said slanted surface comprising moving means for moving a pressing down and fixing section of the upper tool holding device away from said sliding surface.

11. The upper tool according to claim 7, said contact surface comprising means for seating said upper tool in the upper tool holding device.

12. The upper tool according to claim 7, said sliding surface comprising means for linearly adjusting said upper tool in the upper holding device.

13. The upper tool according to claim 7, said sliding surface extending from said first end to said contact surface;

said engaging groove comprising an upper surface and a lower surface; and said slanted surface extending from said first end to said upper surface of said engaging groove, said work processing portion extending from said lower surface of said engaging groove.

14. An upper tool for a press brake, said upper tool for attaching to an upper tool holding device mounted on an upper table of the press brake, said upper tool comprising:

an upper portion adjacent a first end of said upper tool and defining a wedge portion formed between a sliding surface and a surface slanted with respect to said sliding surface;

a lower portion adjacent a second end of said upper tool and comprising a work processing portion;

a contact surface intermediate said upper portion and said lower portion;

said sliding surface positioned perpendicularly with respect to said contact surface; and an engaging groove, in said upper portion, said engaging groove positioned, with respect to said first end, below said slanted surface and substantially perpendicular to said sliding surface, and said engaging groove further positioned, with respect to said first end, between said slanted surface and said contact surface.

15. The upper tool according to claim 14, said slanted surface and said sliding surface gradually and continuously extending away from each other as said slanted surface and said sliding surface approach said second end.

16. The upper tool according to claim 14, said slanted surface comprising moving means for moving a pressing down and fixing section of the upper tool holding device away from said sliding surface.

17. The upper tool according to claim 14, said contact surface comprising means for seating said upper tool in the upper tool holding device.

18. The upper tool according to claim 14, said sliding surface comprising means for linearly adjusting said upper tool in the upper holding device.

19. The upper tool according to claim 14, said slanted surface and said sliding surface comprising an alloy layer.

* * * * *